US007417594B2

(12) United States Patent
Cho et al.

(10) Patent No.: US 7,417,594 B2
(45) Date of Patent: Aug. 26, 2008

(54) MULTIBAND ANTENNA FOR VEHICLES

(75) Inventors: Tae-Kwan Cho, Suwon-si (KR); Young-Sup Bang, Suwon-si (KR); Jin-Ho Kim, Bucheon-si (KR)

(73) Assignee: Motonix Co., Ltd., Hwaseong-si, Gyeonggi-do (KR)

( * ) Notice: Subject to any disclaimer, the term of this patent is extended or adjusted under 35 U.S.C. 154(b) by 0 days.

(21) Appl. No.: 11/515,106

(22) Filed: Sep. 1, 2006

(65) Prior Publication Data

US 2007/0241973 A1 Oct. 18, 2007

(30) Foreign Application Priority Data

Apr. 13, 2006 (KR) ..... 10-2006-0033444

(51) Int. Cl.
*H01Q 1/32* (2006.01)
*H01Q 1/42* (2006.01)
*H01Q 21/00* (2006.01)

(52) U.S. Cl. ..... 343/713; 343/872; 343/879

(58) Field of Classification Search ..... 343/713, 343/702, 895, 872, 879, 700 MS
See application file for complete search history.

(56) References Cited

U.S. PATENT DOCUMENTS

| | | | | |
|---|---|---|---|---|
| 6,522,222 | B1 * | 2/2003 | Pchelnikov et al. | 333/161 |
| 6,525,691 | B2 | 2/2003 | Varadan et al. | |
| 6,670,922 | B1 * | 12/2003 | Huang et al. | 343/700 MS |
| 6,819,295 | B1 * | 11/2004 | Peng et al. | 343/728 |
| 2006/0170610 | A1 * | 8/2006 | Rabinovich et al. | 343/895 |

* cited by examiner

*Primary Examiner*—Shih-Chao Chen
(74) *Attorney, Agent, or Firm*—Ditthavong Mori & Steiner, P.C.

(57) ABSTRACT

Disclosed herein is a multiband antenna for vehicles. The multiband antenna includes a Printed Circuit Board (PCB), at least one radiation unit, and a feeding unit. The PCB is formed within a radome that protects the antenna. The at least one radiation unit is formed on the PCB to be optimized as a Hilbert type meander line composed of a single pattern, and is configured to generate multiband resonant frequencies. The feeding unit is configured to apply signals to the radiation unit.

10 Claims, 6 Drawing Sheets

[Fig 1]
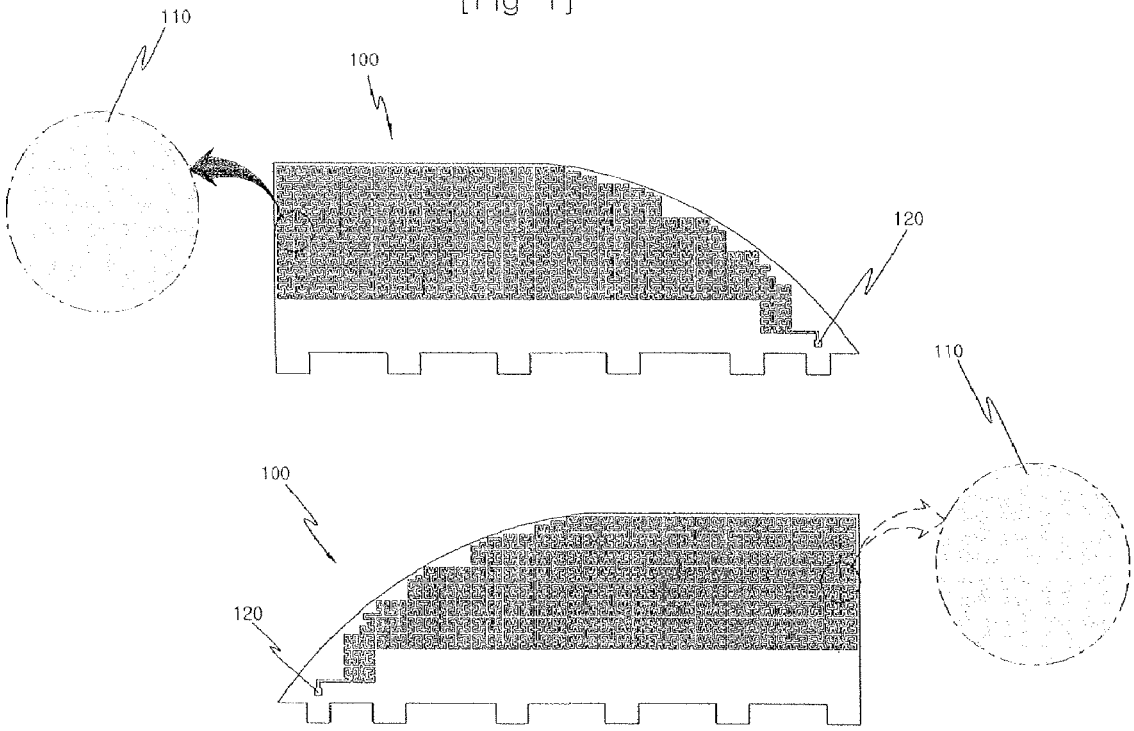

[Fig 2A]
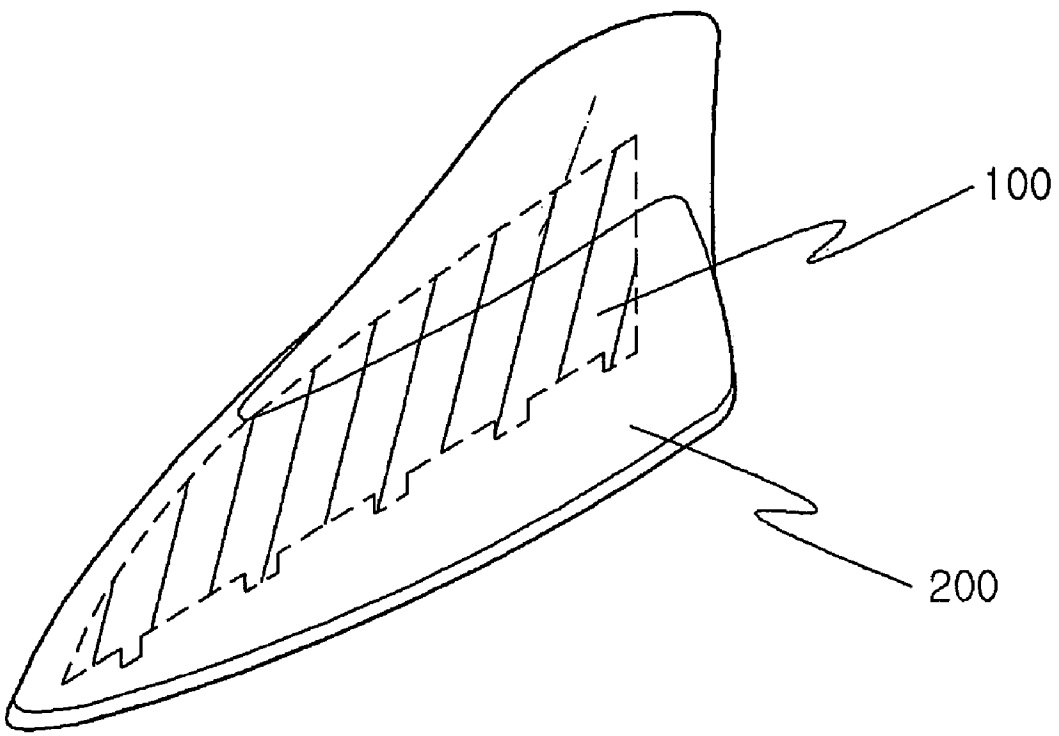

[Fig 2B]
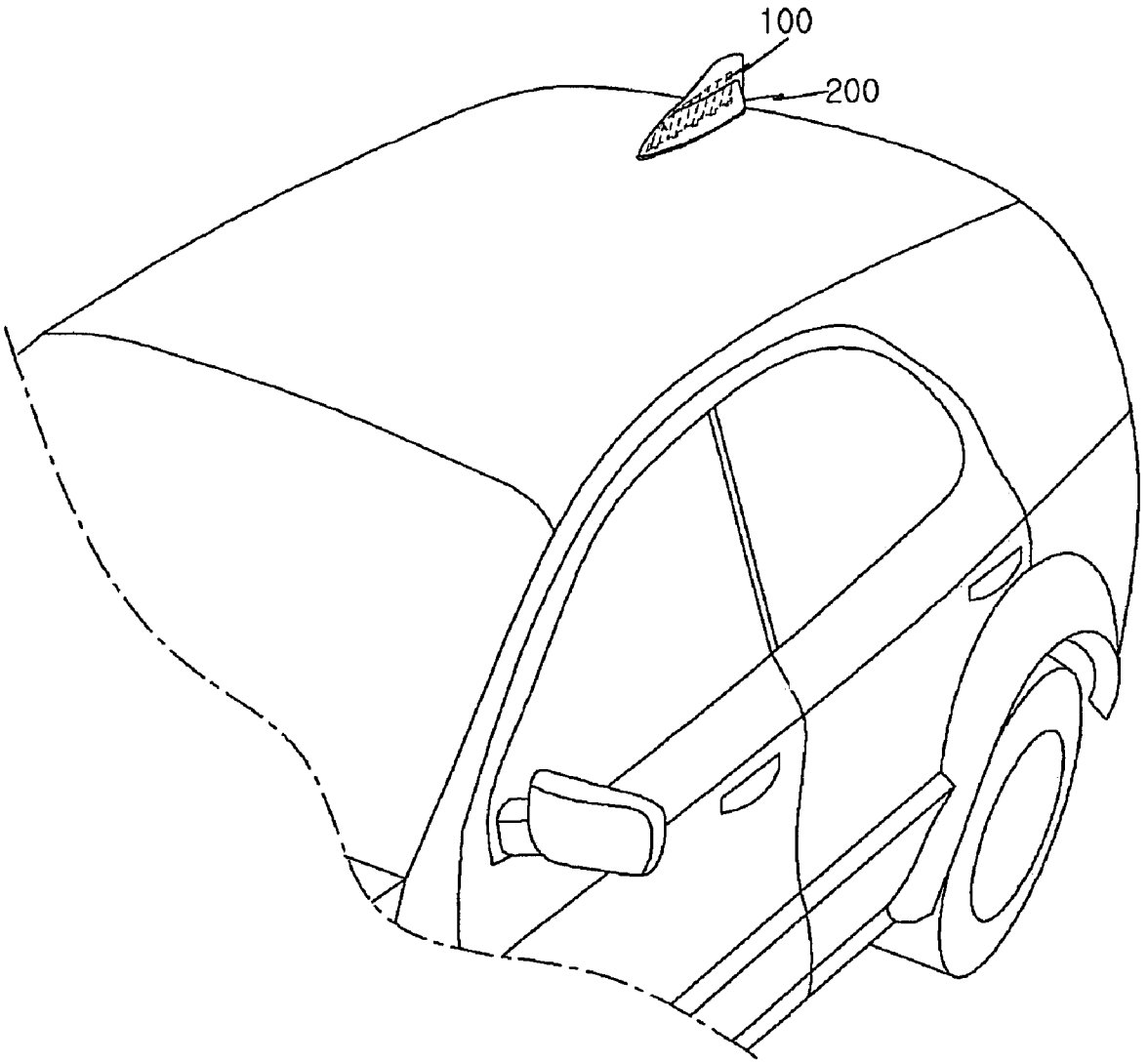

【fig. 3】
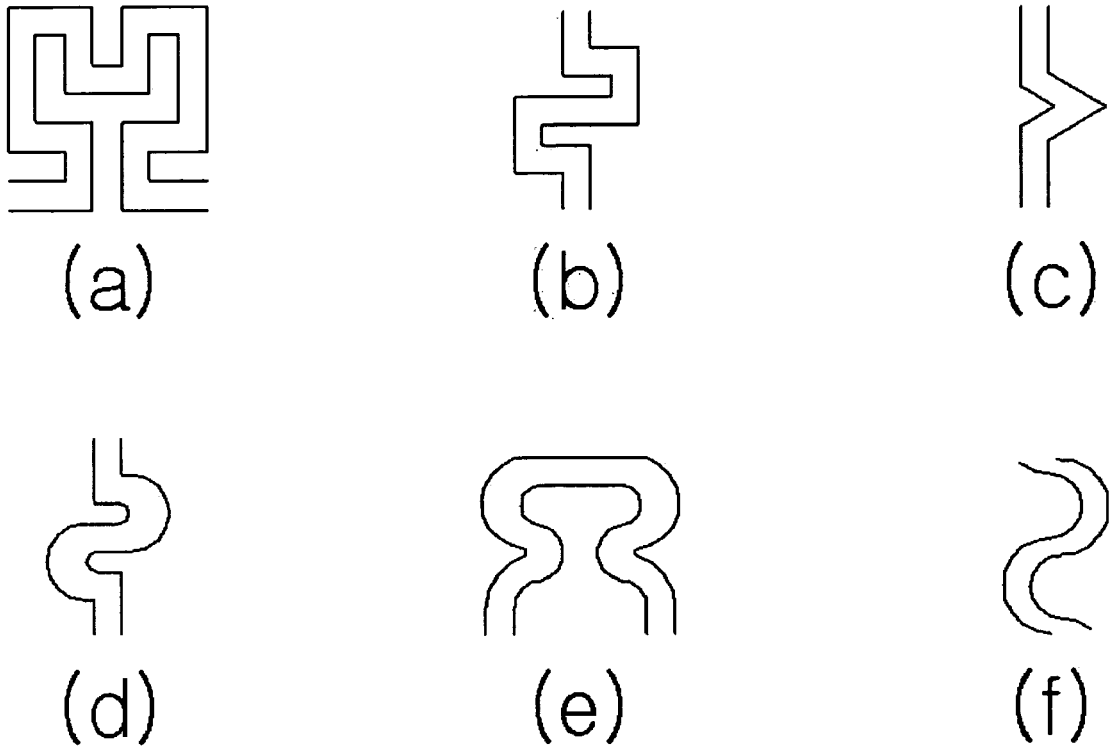

【fig. 4】
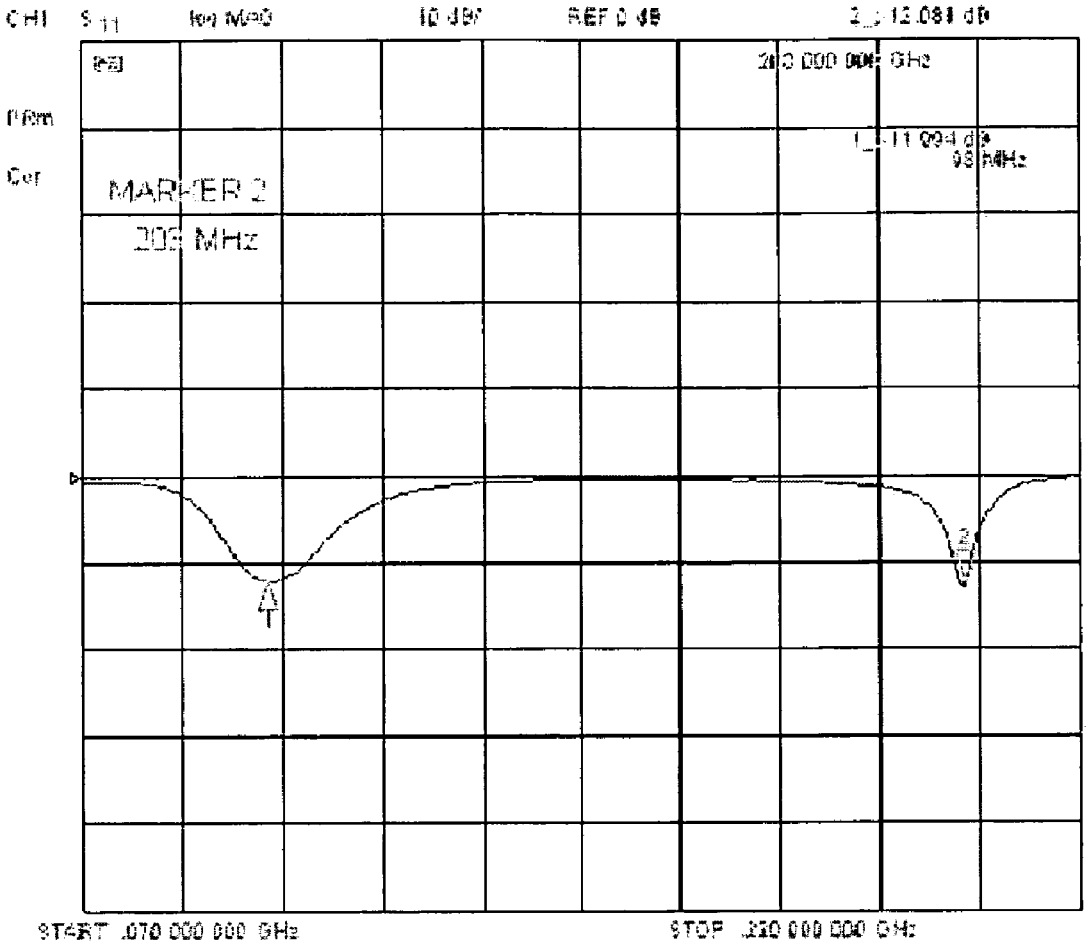

【fig. 5】
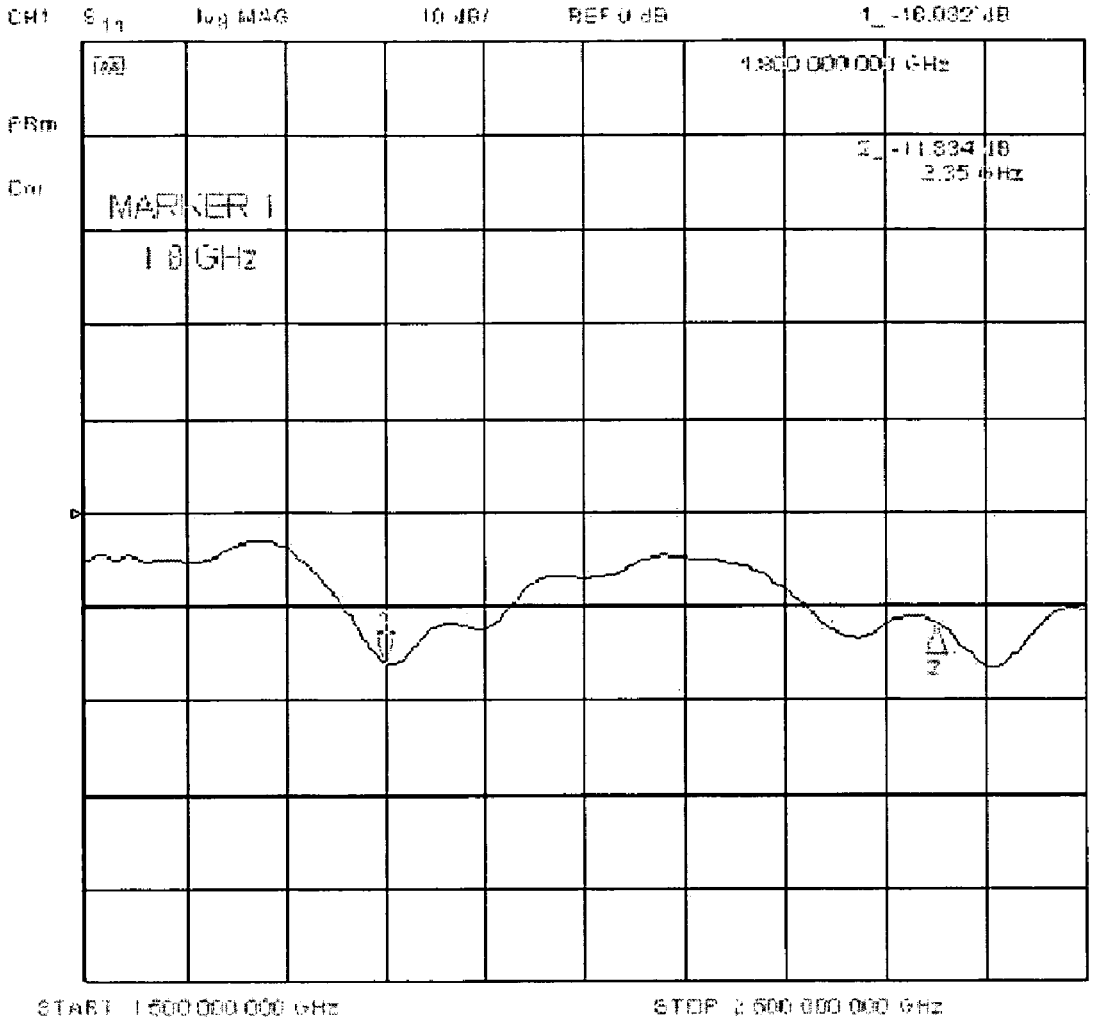

MULTIBAND ANTENNA FOR VEHICLES

BACKGROUND OF THE INVENTION

1. Field of the Invention

The present invention relates, generally, to a multiband antenna for vehicles and, more particularly, to a multiband antenna for vehicles, in which at least one radiation unit is formed on a printed circuit board in optimized Hilbert type meander line form, two radiation units may be symmetrically formed on both sides of the printed circuit board, thereby implementing a high-gain antenna, and antenna characteristics for a fundamental resonant frequency band and antenna characteristics for the AM/FM, terrestrial DMB, PCS and Wibro bands are achieved using a single pattern and high-order harmonics, thereby enabling a user to receive multiband service via a single antenna.

2. Description of the Related Art

With respect to the prior art integrated antenna, Korean Utility Model Application No. 20-2005-0031949 discloses an integrated antenna to be mounted on a vehicle. The integrated antenna according to the Utility Model Application includes a board placed under a radome, a first antenna unit configured to include a radio broadcasting antenna and a terrestrial Digital Multimedia Broadcasting (DMB) antenna that are integrated with each other, connected from the center portion of the board, and placed to be inclined backward, a second antenna unit configured to include a plurality of satellite DMB antennas placed on the board and a Global Positioning System (GPS) antenna and a Personal Communication System (PCS) antenna placed between the satellite DMB antennas, and a radome configured to accommodate the board, the first antenna unit and the second antenna unit.

However, the prior art technology has a problem in that the Amplitude Modulation (AM)/Frequency Modulation (FM) antenna, the terrestrial DMB antenna, the satellite DMB antenna, the GPS antenna and the PCS antenna are combined with the radome for corresponding resonant frequency bands, so that the size of the external design thereof and the size of the radome thereof increase, and interference occurs between the respective antennas, thereby degrading the characteristics of the antenna.

SUMMARY OF THE INVENTION

Accordingly, the present invention has been made keeping in mind the above problems occurring in the prior art, and an object of the present invention is to provide a multiband antenna for vehicles that can operate in a multi-resonant frequency band, including the AM/FM, terrestrial DMB, PCS and Wibro bands, using a radiation unit having a Hilbert type meander line formed of a single pattern, and that is provided with a radome having a considerably reduced design and size based on the optimized pattern structure of the antenna.

In order to accomplish the above object, the present invention provides a multiband antenna for vehicles, including a Printed Circuit Board (PCB) formed within a radome that protects the antenna; at least one radiation unit formed on the PCB to be optimized as a Hilbert type meander line composed of a single pattern, and configured to generate multiband resonant frequencies; and a feeding unit configured to apply signals to the radiation unit.

According to an embodiment of the present invention, the at least one radiation unit includes two radiation units, the radiation units being symmetrically formed on both sides of the PCB.

According to an embodiment of the present invention, the PCB has a streamlined shark shape.

According to an embodiment of the present invention, the radiation unit has a fundamental frequency that is determined by a length of the radiation unit, and a high-order harmonic that is adjusted by a line width and interline interval of the meander line.

According to an embodiment of the present invention, the meander line has a line length of 422±3 cm and a line width of 0.06±0.025 cm.

BRIEF DESCRIPTION OF THE DRAWINGS

The above and other objects, features and advantages of the present invention will be more clearly understood from the following detailed description taken in conjunction with the accompanying drawings, in which:

FIG. 1 is a diagram illustrating the pattern of a multiband antenna for vehicles according to an embodiment of the present invention;

FIG. 2A and 2B are perspective views of the multiband antenna formed within a radome according to various embodiments of the present invention;

FIG. 3 is a diagram illustrating various patterns of a radiation unit according to embodiments of the present invention;

FIG. 4 is a graph illustrating the characteristics of the antenna of the present invention in the FM and DMB bands; and FIG. 5 is a graph illustrating the characteristics of the antenna of the present invention in the PCS and Wibro bands.

DESCRIPTION OF THE PREFERRED EMBODIMENTS

Reference now should be made to the drawings, in which the same reference numerals are used throughout the different drawings to designate the same or similar components.

FIG. 1 is a diagram illustrating the construction of a multiband antenna for vehicles according to an embodiment of the present invention. The multiband antenna includes a Printed Circuit Board (PCB) 100 formed within a radome that protects the antenna, at least one radiation unit 110 formed on the PCB 100 to be optimized as a Hilbert type meander line composed of a single pattern, and configured to generate multiband resonant frequencies, and a feeding unit 120 configured to apply signals to the radiation unit 110.

In detail, the radome 200, as illustrated in FIGS. 2A and 2B, is configured to prevent the antenna from being damaged by external factors, to match vehicles with respect to appearance, thereby improving the aesthetic competitiveness of the antenna, and to enclose a single pattern structure, which is optimized as a Hilbert type meander line, in a streamlined shark shape, thereby reducing air resistance and noise.

On the PCB 100 are formed the radiation unit 110 and the feeding unit 120. The PCB 100 is also formed in a streamlined shark shape. The PCB 100 may be easily fabricated of epoxy, plastic, FR4 or Teflon.

The PCB 100 is vertically formed in the radome 200, which can be mounted on a surface of a vehicle in an orientation perpendicular to the mounting surface. Two radiation units 110 may be symmetrically formed on both sides of the PCB 100 and, thus, can achieve wide band antenna characteristics.

The radiation unit 110 can be optimally formed using a Hilbert type meander line, and operates at resonant frequencies of AM/FM bands of 150~1750 MHz/88~108 MHz, a terrestrial DMB band of 174~216 MHz, a PCS band of 1750~1870 MHz and a Wibro band of 2300~2400 MHz.

Furthermore, the antenna can be allowed to operate at the fundamental frequency of the FM band by adjusting the total length of the meander line of the radiation unit 110, and the resonant frequencies of the terrestrial DMB, PCS and Wibro bands can be utilized using the high-order harmonics of the fundamental frequency of the FM band.

Furthermore, the radiation unit 110 matches input impedance to higher impedance and, thus, generates the resonant frequencies of the AM band via a buffer and an amplifier.

The total length of the meander line of the radiation unit 110 is given by the following Equation:

$$L=[L0*5/3\hat{}NJ*K$$

where N is a repetition scale number and K is a scale factor.

In a preferred embodiment, when the total line length of the meander line of the radiation unit 110 is 422 cm, optimal antenna characteristics are exhibited. The radiation unit 110 can operate within an error range of ±3 cm. The line length of the meander line of the radiation unit 110 is 422±3 cm, while the line width thereof is 0.06±0.025 cm.

Furthermore, in the radiation unit 110, optimized Hilbert type meander line patterns are symmetrically formed on both sides of the PCB 100, so that the characteristics of the antenna are stable and high-gain antenna characteristics can be achieved.

In particular, the radiation unit 110, as illustrated in FIG. 3, may have one of (a) the Hilbert type pattern, (b) a zigzag-shaped pattern, (c) a triangle-shaped pattern, (d) an S-shaped pattern, (e) an 8-shaped pattern, and (e) a circle-shaped pattern. The fundamental resonant frequency of the FM band, that is, a fundamental frequency, is determined by adjusting the length of the radiation unit 110, while the resonant frequencies of the terrestrial DMB, PCS and Wibro bands are determined using high-order harmonics generated based on the fundamental resonant frequency of the FM band, and capacitive and inductive components generated while adjusting the line width and interline interval of the radiation unit 110.

Accordingly, the radiation unit 110 is formed of a meander line pattern having a single line, and generates the resonant frequencies of the AM/FM, terrestrial DMB, PCS and Wibro bands via a single antenna. The meander line pattern of the radiation unit 110 employs a Hilbert type structure, and thus constitutes a very small optimized antenna.

The feeding unit 120 transmits external signals to the radiation unit 110. The fundamental resonant frequency of the FM band can be adjusted by changing the location of the feeding unit 120. Accordingly, it can be appreciated that the location of the feeding unit 120 can be changed according to the intended use.

FIG. 4 is a graph illustrating the characteristics of the antenna of the present invention in the FM and DMB bands. From the drawing, it can be understood that impedance matching is achieved at the resonant frequencies of the FM band of 88~108 MHz and the terrestrial DMB band of 174~216 MHz, so that precise desired characteristics and a return loss of −12 dB are exhibited.

FIG. 5 is a graph illustrating the characteristics of the antenna of the present invention in the PCS and Wibro bands. From the drawing, it can be understood that precise impedance matching is achieved at the resonant frequencies of the PCS band of 1750~1870 MHz and the Wibro band of 2300~2400 MHz, so that desired characteristics and a return loss of −12 dB are exhibited.

As described above, in the present invention, radiation units may be optimally formed on both sides of the PCB in a Hilbert type meander line form, so that small-size, wideband and high-gain antenna characteristics can be achieved, and high-order harmonic bands as well as the fundamental resonant frequency band of the radiation unit are utilized, so that multi-frequency band service can be received using a single antenna that operates in ranges of resonant frequencies of the AM/FM, terrestrial DMB, PCS and Wibro bands.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

The invention claimed is:

1. A multiband antenna for a vehicle, comprising:

a printed circuit board (PCB);

a first radiation unit having a single pattern formed on the PCB;

a second radiation unit having a pattern formed on the PCB in a symmetrical orientation with the single pattern of the first radiation unit, wherein the PCB has a streamlined shark shape and each of the first and second radiation units has a fundamental frequency that is determined by a length of the respective radiation unit, and has a high-order harmonic that is adjusted by a line width and an interval of the pattern, wherein the PCB is formed within a structural enclosure to protect the pattern, wherein the PCB is provided perpendicular to a vehicle mounting surface; and a feeding unit configured to apply signals to the first and the second radiation units.

2. A multiband antenna according to claim 1, wherein the first and the second radiation units are symmetrically formed on both sides of the PCB.

3. A multiband antenna according to claim 1, wherein the pattern has a line length of about 422±3 cm and a line width of about 0.06±0.025 cm.

4. A multiband antenna according to claim 1, wherein the pattern includes at least one of a Hilbert type pattern, a zigzag shaped pattern, a triangle shaped pattern, an S shaped pattern, an eight shaped pattern or a circle shaped pattern.

5. An antenna system, comprising:

a printed circuit board (PCB) having a first side surface and a second side surface oriented in a direction opposite to the first side surface;

a first radiation unit having a single pattern formed on the first side of the PCB;

a second radiation unit having a symmetrical pattern of the first radiation unit formed on the second side of the PCB, wherein the PCB has a streamlined shark shape and each of the first and second radiation units has a fundamental frequency that is determined by a length of the respective radiation unit, and has a high-order harmonic that is adjusted by a line width and an interval of the pattern, wherein the PCB is formed within a structural enclosure to protect the pattern, wherein the PCB is provided perpendicular to a vehicle mounting surface; and a feeding unit configured to apply a signal to the first radiation unit and the second radiation unit.

6. An antenna system according to claim 5, wherein the pattern includes at least one of a Hilbert type pattern, a zigzag shaped pattern, a triangle shaped pattern, an S shaped pattern, an eight shaped pattern or a circle shaped pattern.

7. An antenna system according to claim 5, wherein a length of the pattern is about 422±3 cm and a width of the pattern is about 0.06±0.025 cm.

8. An apparatus for transmitting and receiving a signal over multiple bandwidths, comprising:

a printed circuit board (PCB) has a radiation unit having a single pattern symmetrically formed on each side of the PCB, wherein the PCB has a streamlined shark shape and the radiation unit has a fundamental frequency that is determined by a length of the radiation unit, and has a high-order harmonic that is adjusted by a line width and an interval of the pattern;

a feeding unit configured to apply a signal to the radiation unit; and a radome is configured to protect the pattern, wherein the PCB is vertically mounted within the radome in an orientation perpendicular to a vehicle mounting surface.

9. An apparatus according to claim 8, wherein the pattern includes at least one of a Hilbert type pattern, a zigzag shaped pattern, a triangle shaped pattern, an S shaped pattern, an eight shaped pattern or a circle shaped pattern.

10. An apparatus according to claim 8, wherein a length of the pattern is about 422±3 cm and a width of the pattern 0.06±0.025 cm.

* * * * *